US010292430B2

(12) United States Patent
Zhang et al.

(10) Patent No.: US 10,292,430 B2
(45) Date of Patent: May 21, 2019

(54) ELECTRONIC CIGARETTE WITH SEPARATED DRIVING PASSAGE AND VAPOR PASSAGE

(71) Applicant: ALD GROUP LIMITED, Shenzhen, Guangdong Province (CN)

(72) Inventors: Haibo Zhang, Shenzhen (CN); Yi Ding, Shenzhen (CN)

( * ) Notice: Subject to any disclaimer, the term of this patent is extended or adjusted under 35 U.S.C. 154(b) by 0 days.

(21) Appl. No.: 15/632,278

(22) Filed: Jun. 23, 2017

(65) Prior Publication Data

US 2018/0303162 A1 Oct. 25, 2018

(30) Foreign Application Priority Data

Apr. 21, 2017 (CN) ..... 2017 1 0265182

(51) Int. Cl.

| | |
|---|---|
| ***A24F 11/00*** | (2006.01) |
| ***A24F 1/32*** | (2006.01) |
| ***A24F 25/02*** | (2006.01) |
| ***A24F 13/26*** | (2006.01) |
| ***A24F 1/00*** | (2006.01) |
| ***A24F 47/00*** | (2006.01) |

(52) U.S. Cl.
CPC ..... *A24F 47/008* (2013.01); *A24F 47/002* (2013.01)

(58) Field of Classification Search
CPC ..... A24F 47/008; A61M 15/0091; A61M 2016/0015; A61M 2016/003
USPC ..... 131/330, 328, 329
See application file for complete search history.

(56) References Cited

U.S. PATENT DOCUMENTS

2015/0208726 A1* 7/2015 Liu ..... A24F 47/008 131/329
2016/0150823 A1* 6/2016 Liu ..... H05B 3/46 131/328
2018/0020738 A1* 1/2018 Qiu ..... F22B 1/284 131/329

FOREIGN PATENT DOCUMENTS

WO WO2017210969 * 12/2017 ..... A24F 47/008

* cited by examiner

*Primary Examiner* — Abdullah A Riyami
*Assistant Examiner* — Thang H Nguyen
(74) *Attorney, Agent, or Firm* — Novoclaims Patent Services LLC; Mei Lin Wong

(57) ABSTRACT

An electronic cigarette which includes a battery component, an atomization component, a pneumatic switch which controls the atomization component to operate, a mouthpiece and an airflow channel. The airflow channel includes a vapor channel and an actuator airflow channel which are independent to each other. The vapor channel is communicating with an atomization chamber of the atomization component and the mouthpiece while open through to atmospheric environment outside. The actuator airflow channel is communicating with the mouthpiece and open through to atmospheric environment outside. The pneumatic switch is arranged in the actuator airflow channel.

6 Claims, 2 Drawing Sheets

ELECTRONIC CIGARETTE WITH SEPARATED DRIVING PASSAGE AND VAPOR PASSAGE

BACKGROUND OF THE PRESENT INVENTION

Field of Invention

The present invention relates to an electronic cigarette (e-cigarette) device, and more particularly to an electronic cigarette which has separated driving passage and vapor passage.

Description of Related Arts

Electronic cigarette utilizes battery for power supply to the heating element which process heating and atomization of the e-liquid. Then, the aerosol from atomization of e-liquid is inhaled through the mouthpiece of the e-cigarette. Accordingly, the effect similar to smoking is achieved. Through reasonable mix and ratio of the ingredients of the e-liquid, the effect of quitting smoking or alternative smoking is achieved.

Amongst the e-cigarette products, there are two ways to start. One is to use an external switch to start the atomizer of the e-cigarette but the operation is troublesome. At present, the e-cigarette mostly uses another method, which is, adding a pneumatic switch on the airflow channel of the e-cigarette. The airflow generated during vaping can start the atomizer of the e-cigarette directly. In this way, the vaping experience is similar to actual smoking. When the e-cigarette is in use, liquid such as condensate and penetrating vape oil is generated. If the liquid flows to the pneumatic switch through the airflow channel, the pneumatic switch will be damaged and the life of the e-cigarette is shortened.

There is another drawback to use the pneumatic switch on the airflow channel of the e-cigarette. The airflow volume passing through the airflow channel in unit time during vaping will affect the experience of vaping. When the flow rate is relatively small, vaping will have a sense of suffocation. If the flow rate of the vapor is increased by increasing the diameter of the airflow channel, the sensitivity of the actuation switch is reduced and hence the atomizer of the e-cigarette cannot start immediately. Therefore, it is necessary to further improve the structure of the e-cigarette.

SUMMARY OF THE PRESENT INVENTION

An object of the present invention is to provide an electronic cigarette which can prevent the backflow of condensate and oil of the e-liquid into its pneumatic switch and prevent damage to the pneumatic switch, while the sensitivity of the pneumatic switch is not affected by the diameter of the airflow channel of e-cigarette.

According to the present invention, the foregoing and other objects and advantages are attained by an electronic cigarette which comprises a battery component, an atomization component, a pneumatic switch which controls the starting of the atomization component, a mouthpiece and an airflow channel, wherein the airflow channel comprises a vapor channel and an actuator airflow channel which are independent to each other, wherein the vapor channel is connected to atomization chamber of the atomization component and the mouthpiece, and open through to the atmospheric environment outside, wherein the actuator airflow channel is connected to the mouthpiece and open through to the atmospheric environment outside, wherein the pneumatic switch is arranged in the actuator airflow channel.

The advantageous effect of the present invention is that: the present invention provides an electronic cigarette which separate vapor channel and actuator airflow channel, the vape oil and condensate will not flow to the same channel as the actuator airflow channel and therefore cannot have any contact with the pneumatic switch, thus the life of the pneumatic switch is prolonged. In addition, the adjustment of airflow volume in the vapor channel and the adjustment of sensitivity of the pneumatic switch which is positioned in the actuator airflow channel are not related and affected by each other. Accordingly, the flow rate in unit time of the vapor channel as well as the actuator sensitivity of the actuator airflow channel can be adjusted to suitable level and the comfort level of vaping is enhanced.

BRIEF DESCRIPTION OF THE DRAWINGS

The present invention is further illustrated in details with the following accompany drawings.

In FIG. 1 and FIG. 2: 11: case body, 12: battery compartment body, 13: mouthpiece, 14: atomizer support, 21: atomizer base, 22: atomization chamber, 23: liquid transmission element, 24: heating element, 25: liquid tank, 26: atomizer bottom basin, 27: vapor channel inlet, 28: vapor channel, 31: pneumatic switch base, 32: pneumatic switch, 33: sealing pad, 34: actuator airflow channel, 36: inlet.

DETAILED DESCRIPTION OF THE PREFERRED EMBODIMENT

Figure 1:
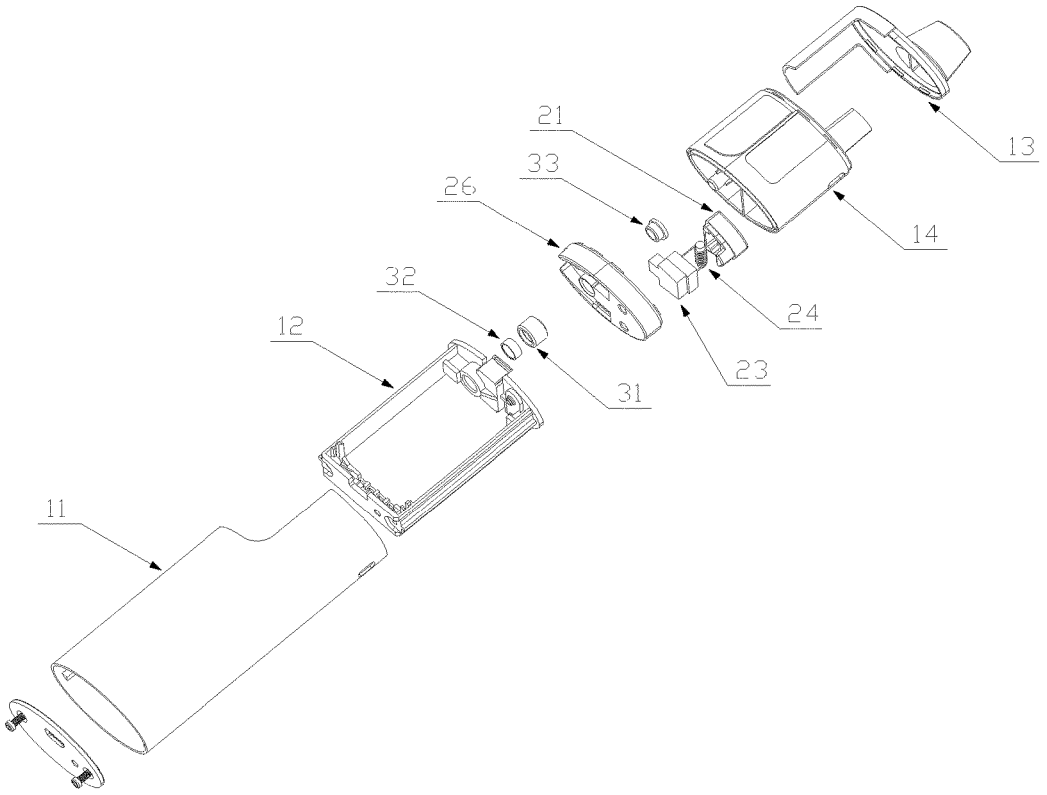
FIG. 1 is an exploded structural illustration of an electronic cigarette according to the preferred embodiment of the present invention.
Figure 2:
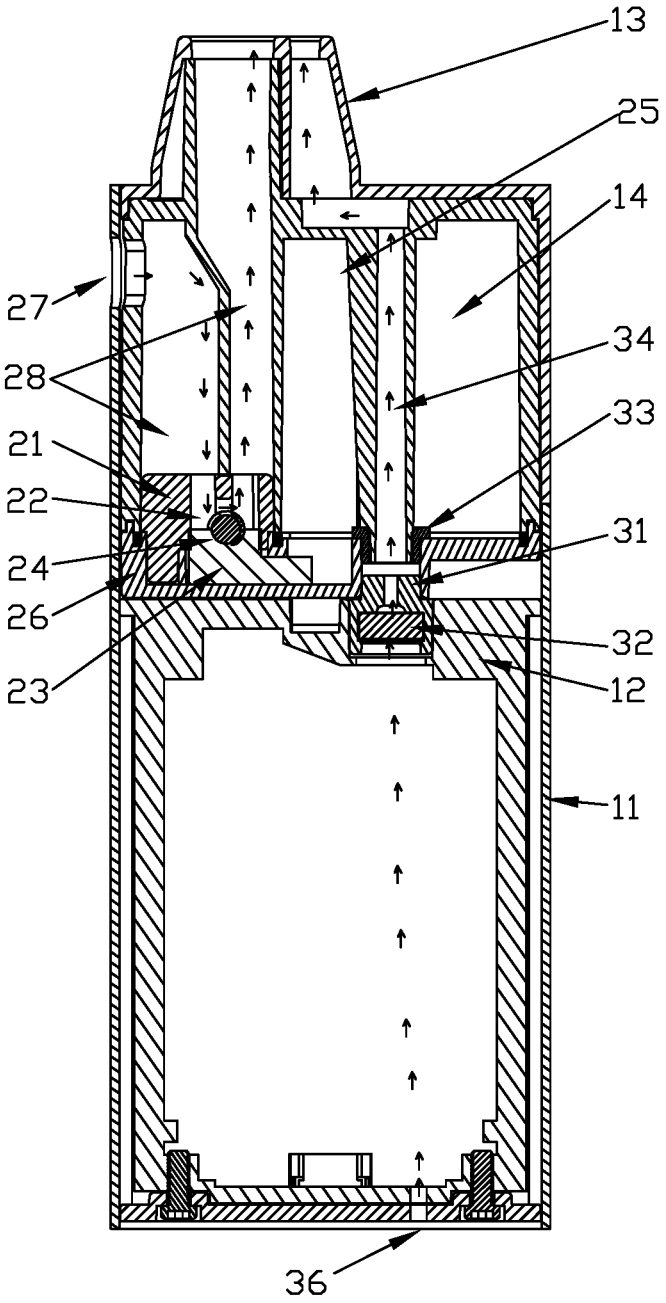
FIG. 2 is an illustration of the airflow direction of a vapor channel and an actuator airflow channel of the electronic cigarette according to the preferred embodiment of the present invention.

Referring to FIGS. 1 and 2 of the drawings, the present invention provides an electronic cigarette (e-cigarette) device which comprises a battery component (battery is not illustrated in the drawings), an atomization component, a pneumatic switch 32 which control the start of the atomization component, a mouthpiece and an airflow channel, wherein the airflow channel comprises a vapor channel 28 and an actuator airflow channel 34 which are two channels independent to each other, wherein the vapor channel 28 are connected to atomization chamber 22 of the atomization component and mouthpiece 13, and open through to the atmospheric environment outside, wherein the actuator airflow channel 34 is connected to the mouthpiece 13 and open to the atmospheric environment outside through an inlet 36, wherein the pneumatic switch 32 is arranged in the actuator airflow channel. As shown in FIG. 2 of the drawings, one end of the vapor channel 28 and the actuator airflow channel 34 respectively are connected through to the atmospheric environment. Through the mouthpiece 13 during vaping, both of the vapor channel 28 and the actuator airflow channel 34 are open, the atmospheric air will enter to the mouth of a smoker through the actuator airflow channel 34 and will pass through the pneumatic switch 32 arranged in the actuator airflow channel 34, the pneumatic switch 32 is turned on and the heating element 24 of the atomization component starts to operate, the heating element 24 processes the atomization of the vape oil which will flow along with the atmospheric air to the mouth of the smoker after atomization. The pneumatic switch can detect the pressure changes inside the actuator airflow channel and operate, or can detect the impact of airflow and operate. The working principle of the pneumatic switch is well known to the skilled in the electronic cigarette industry and is not repeated here. The airflow passes through the atomization chamber 22 of the atomization component and its temperature will be increased. The airflow may be condensed into liquid form when passing through the wall of the vapor channel 28. The liquid transmission element 23 may also contain vape oil. According to this embodiment of the present invention, the pneumatic switch 32 and the atomization component are not arranged in the same channel, therefore the vape oil and condensed liquid will not flow to the pneumatic switch 32 or cause damage to the pneumatic switch 32. Compared to the electronic cigarette in which the vapor channel 28 and the actuator airflow channel 34 are combined together, the present invention prolongs the lifespan of the electronic cigarette. Also, the diameter of the opening of the actuator airflow channel 34 will directly affect the sensitivity of the pneumatic switch 32. When the diameter of the opening of the actuator airflow channel is decreased, a sense of suffocation will be resulted when the vapor is inhaled. Therefore, the vapor channel 28 and the actuator airflow channel 34 which are combined together fail to take into account of the sensitivity of the pneumatic switch 32 and the sense of suffocation during vaping. The present invention separates the vapor channel 28 and the actuator airflow channel 34 and solves the problem.

According to this preferred embodiment of the present invention, preferably, the atomization component comprises an atomizer support 14, and a liquid tank 25 and an atomizer base 21 mounted securely inside the atomizer support 14. The atomizer base 21 is indented to define an atomization chamber 22. The atomization chamber 22 contains liquid transmission element 23 therein. The heating element 24 in the form of heating wire is wound around the liquid transmission element 23. The liquid transmission element 23 has one end connected to the liquid tank 25. The atomizer support 14 has one or more vapor channel inlets provided thereon. The atomizer support 14 has a side wall at an inner side and the liquid tank 25 has a side wall at an outer side. The side wall at the inner side of the atomizer support 14 and the side wall at the outer side of the liquid tank 25 are arranged to form a first airflow channel, which is communicating with the vapor channel inlet, the atomization chamber 22 and the mouthpiece 13 so as to define the vapor channel. The liquid tank 25 is made of transparent or semi-transparent materials so that the remaining amount of vape oil inside the liquid tank 25 can be seen conveniently. The use of the side wall at the inner side of the atomizer support 14 and the side wall at the outer side of the liquid tank 25 to construct the first airflow channel is a simple structure and the cost of additional materials for its construction is eliminated.

According to this preferred embodiment of the present invention, preferably, the pneumatic switch 32 is arranged on top of the battery compartment body 12 and the pneumatic switch 32 is communicating with the actuator airflow channel 34. In order to increase the airtightness, sealing pad 33 is provided at the peripheral edge of the pneumatic switch 32. The pneumatic switch 32 can be arranged at any position in the actuator airflow channel for the normal operation of the electronic cigarette. The reason for positioning the pneumatic switch 32 on top of the battery compartment body 12 is that the space availability on top of the battery compartment body is great and the production of electronic cigarette is facilitated.

One skilled in the art will understand that the embodiment of the present invention as shown in the drawings and described above is exemplary only and not intended to be limiting. It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. An electronic cigarette device, comprising:

a battery component at a bottom portion of said electronic cigarette device, an atomization component having an atomization chamber on top of said battery component, a pneumatic switch which controls starting of the atomization component directly and positioned on top of said battery component, a mouthpiece at a top end of said electronic cigarette device, and an airflow channel unit, which comprises a vapor channel and an actuator airflow channel which are two separate and independent airflow channels, wherein said vapor channel is communicating between said atomization chamber of said atomization component and said mouthpiece while communicating to outside atmospheric environment through said mouthpiece, wherein said actuator airflow channel is connected to said mouthpiece and is communicating to outside atmospheric environment through said mouthpiece, wherein said pneumatic switch is positioned inside said actuator airflow channel and having a sensitivity directly affected by said actuator airflow channel, thereby through said pneumatic switch having the sensitivity directly affected by said actuator airflow channel while said vapor channel having a diameter not correlated to a diameter of said actuator airflow channel, a simple on and off control of said electronic cigarette device by said pneumatic switch through said actuator airflow channel as well as a direct control of vape flow through said diameter of said vapor channel is achieved.

2. The electronic cigarette device according to claim 1, wherein said atomization component comprises an atomizer support, and a liquid tank and an atomizer base mounted securely inside said atomizer support, wherein said atomizer base is indented to define an atomization chamber therein, wherein said electronic cigarette further comprises a liquid transmission element inside said atomization chamber having one end connecting to a liquid tank; and a heating element wound around said liquid transmission element, wherein said atomizer support has one or more vapor channel inlets provided thereon, wherein a first airflow channel is constructed by a side wall at an inner side of said atomizer support and a side wall at an outer side of said liquid tank, wherein said first airflow channel, said vapor channel inlet, said atomization chamber and said mouthpiece are communicating with each other to define said vapor channel.

3. The electronic cigarette device according to claim 1, wherein said pneumatic switch is positioned immediately on top of said battery compartment body and communicating with said actuator airflow channel.

4. An electronic cigarette device, comprising:

a case body defining an upper side and a bottom side having an inlet at said bottom side;

a battery compartment body arranged for receiving a battery for power supply received inside said case body at said bottom side of said case body;

a mouthpiece provided at said upper side of said case body arranged for communicating with outside;

an actuator airflow channel having one end connecting to said mouthpiece;

a pneumatic switch communicating between said inlet and said mouthpiece through said actuator airflow channel in such a manner that a sensitivity of said pneumatic switch is correlated directly to a diameter of an opening of said actuator airflow channel and said pneumatic switch provides an on and off control of said electronic cigarette directly;

an atomization component comprising an atomization chamber for atomization process actuated by said pneumatic switch directly; and a vapor channel having one end connecting to said mouthpiece, separated from and independent of said actuator airflow channel, communicating said atomization chamber to said mouthpiece in such a manner that vapor generated from said atomization component is guided to flow from said atomization chamber to exit through said mouthpiece and a flow rate of the vapor is directly controlled by a diameter of said vapor channel.

5. The electronic cigarette device according to claim 4, wherein said atomization component comprises an atomizer support, and a liquid tank and an atomizer base mounted securely inside said atomizer support, wherein said atomizer base is indented to define an atomization chamber therein, wherein said electronic cigarette further comprises a liquid transmission element inside said atomization chamber having one end connecting to a liquid tank; and a heating element wound around said liquid transmission element, wherein said atomizer support has one or more vapor channel inlets provided thereon, wherein a first airflow channel is constructed by a side wall at an inner side of said atomizer support and a side wall at an outer side of said liquid tank, wherein said first airflow channel, said vapor channel inlet, said atomization chamber and said mouthpiece are communicating with each other to define said vapor channel.

6. The electronic cigarette device according to claim 5, wherein said pneumatic switch is positioned immediately on top of said battery compartment body and communicating with said actuator airflow channels.

* * * * *